US009546669B2

(12) United States Patent
Beers et al.

(10) Patent No.: US 9,546,669 B2
(45) Date of Patent: Jan. 17, 2017

(54) COMPRESSOR HOUSING FOR AN AIR CYCLE MACHINE

(71) Applicant: Hamilton Sundstrand Corporation, Windsor Locks, CT (US)

(72) Inventors: Craig M. Beers, Wethersfield, CT (US); Brent J. Merritt, Southwick, MA (US); Christopher McAuliffe, Windsor, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 866 days.

(21) Appl. No.: 13/871,298

(22) Filed: Apr. 26, 2013

(65) Prior Publication Data

US 2014/0199167 A1 Jul. 17, 2014

Related U.S. Application Data

(60) Provisional application No. 61/751,343, filed on Jan. 11, 2013.

(51) Int. Cl.
*F04D 29/44* (2006.01)

(52) U.S. Cl.
CPC ..... *F04D 29/444* (2013.01); *Y10T 29/49236* (2015.01)

(58) Field of Classification Search
CPC .... F01D 25/243; F01D 9/045; F04D 29/4206; F04D 29/441; F04D 29/462; F04D 29/083; F04D 29/061; F04D 29/161; F04D 29/162; F04D 29/601–29/602; F04D 29/624; F04D 29/444; F02C 6/12

(Continued)

(56) References Cited

U.S. PATENT DOCUMENTS 2,296,703 A * 9/1942 Butler ..... F01D 25/18 D25/18
2,860,827 A * 11/1958 Egli ..... F01D 5/025 277/412

(Continued)

FOREIGN PATENT DOCUMENTS

| | | |
|---|---|---|
| CN | 101558219 | 10/2009 |
| CN | 102536911 | 7/2012 |
| CN | 102834622 | 12/2012 |

OTHER PUBLICATIONS

Chinese Patent Application No. 201410011602.7 First Office Action, Issued Aug. 3, 2016, 6 pages.

*Primary Examiner* — Craig Kim
*Assistant Examiner* — Julian Getachew
(74) *Attorney, Agent, or Firm* — Cantor Colburn LLP

(57) ABSTRACT

A compressor housing for an air cycle machine is provided. The compressor housing includes a body having a compressor volute configured to provide centrifugal compression in the air cycle machine. A mating surface is integrally formed with the body. The mating surface includes a plurality of substantially equally angularly spaced bosses. The bosses include a first boss type at a first radial distance and configured to receive a threaded fastener coupled to a turbine nozzle of the air cycle machine. The bosses also include a second boss type at a second radial distance configured to secure a seal plate of the air cycle machine. The second radial distance is less than the first radial distance. A ratio of a number of the bosses of the first boss type to the second boss type is 17 to 2.

18 Claims, 4 Drawing Sheets

(58) Field of Classification Search
USPC ..... 415/211.1, 209.2, 208.3–208.4
See application file for complete search history.

(56) References Cited

U.S. PATENT DOCUMENTS

| | | | | | |
|---|---|---|---|---|---|
| 4,116,503 | A | * | 9/1978 | Licht | F16C 17/042 384/123 |
| 4,507,939 | A | * | 4/1985 | Wieland | F04D 29/063 384/453 |
| 5,214,935 | A | * | 6/1993 | Brunskill | B64D 13/06 165/103 |
| 5,224,842 | A | | 7/1993 | Dziorny et al. | |
| 7,140,839 | B2 | | 11/2006 | McAuliffe et al. | |
| 7,402,020 | B2 | | 7/2008 | Beers et al. | |
| 7,779,644 | B2 | | 8/2010 | Decrisantis et al. | |
| 2012/0114463 | A1 | | 5/2012 | Beers et al. | |
| 2012/0156008 | A1 | | 6/2012 | Chrabascz et al. | |
| 2012/0156018 | A1 | | 6/2012 | Rosen et al. | |
| 2012/0156028 | A1 | | 6/2012 | Colson et al. | |

* cited by examiner

COMPRESSOR HOUSING FOR AN AIR CYCLE MACHINE

CROSS REFERENCE TO RELATED APPLICATIONS

This application claims priority to U.S. Provisional Patent Application Ser. No. 61/751,343, filed Jan. 11, 2013, the entire contents of which are specifically incorporated by reference herein.

BACKGROUND OF THE INVENTION

Exemplary embodiments of the invention generally relate to aircraft environmental control systems and, more particularly, to a compressor housing of an air cycle machine utilized as part of an aircraft environmental control system.

Conventional aircraft environmental control systems (ECS) incorporate an air cycle machine (ACM), also referred to as an air cycle cooling machine, for cooling and dehumidifying air supplied to an aircraft cabin. An ACM may include a centrifugal compressor and a centrifugal turbine mounted for co-rotation on a shaft. The centrifugal compressor further compresses partially compressed air, such as bleed air received from a compressor of a gas turbine engine. The compressed air discharges to a downstream heat exchanger or other system before returning to the centrifugal turbine. The compressed air expands in the turbine to thereby drive the compressor. The air output from the turbine may be utilized as an air supply for a vehicle, such as the cabin of an aircraft.

BRIEF DESCRIPTION OF THE INVENTION

According to one embodiment of the invention, a compressor housing for an air cycle machine is provided. The compressor housing includes a body having a compressor volute configured to provide centrifugal compression in the air cycle machine. A mating surface is integrally formed with the body. The mating surface includes a plurality of substantially equally angularly spaced bosses. The bosses include a first boss type at a first radial distance and configured to receive a threaded fastener coupled to a turbine nozzle of the air cycle machine. The bosses also include a second boss type at a second radial distance configured to secure a seal plate of the air cycle machine. The second radial distance is less than the first radial distance. A ratio of a number of the bosses of the first boss type to the second boss type is 17 to 2.

According to another embodiment of the invention, an air cycle machine assembly is provided. The air cycle machine assembly includes a plurality of turbine nozzles, a seal plate, and a compressor housing. The compressor housing includes a body and a mating surface integrally formed with the body. The body includes a compressor volute configured to provide centrifugal compression. The mating surface includes a plurality of substantially equally angularly spaced bosses. The bosses include a first boss type at a first radial distance and configured to receive a threaded fastener coupled to one of the turbine nozzles. The bosses also include a second boss type at a second radial distance configured to secure the seal plate. The second radial distance is less than the first radial distance. A ratio of a number of the bosses of the first boss type to the second boss type is 17 to 2.

A method of installing a compressor housing in an air cycle machine assembly includes aligning a seal plate to a mating surface of the compressor housing. The compressor housing includes a body, where the mating surface is integrally formed with the body. The mating surface includes a plurality of substantially equally angularly spaced bosses. The bosses include a first boss type at a first radial distance and a second boss type at a second radial distance that is less than the first radial distance. A ratio of a number of the bosses of the first boss type to the second boss type is 17 to 2. The seal plate is secured to the bosses of the second boss type at each of the bosses of the second boss type. A turbine nozzle is aligned with each of the bosses. Each of the turbine nozzles aligned with each of the bosses of the first boss type is clamped to the compressor housing using threaded fasteners.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
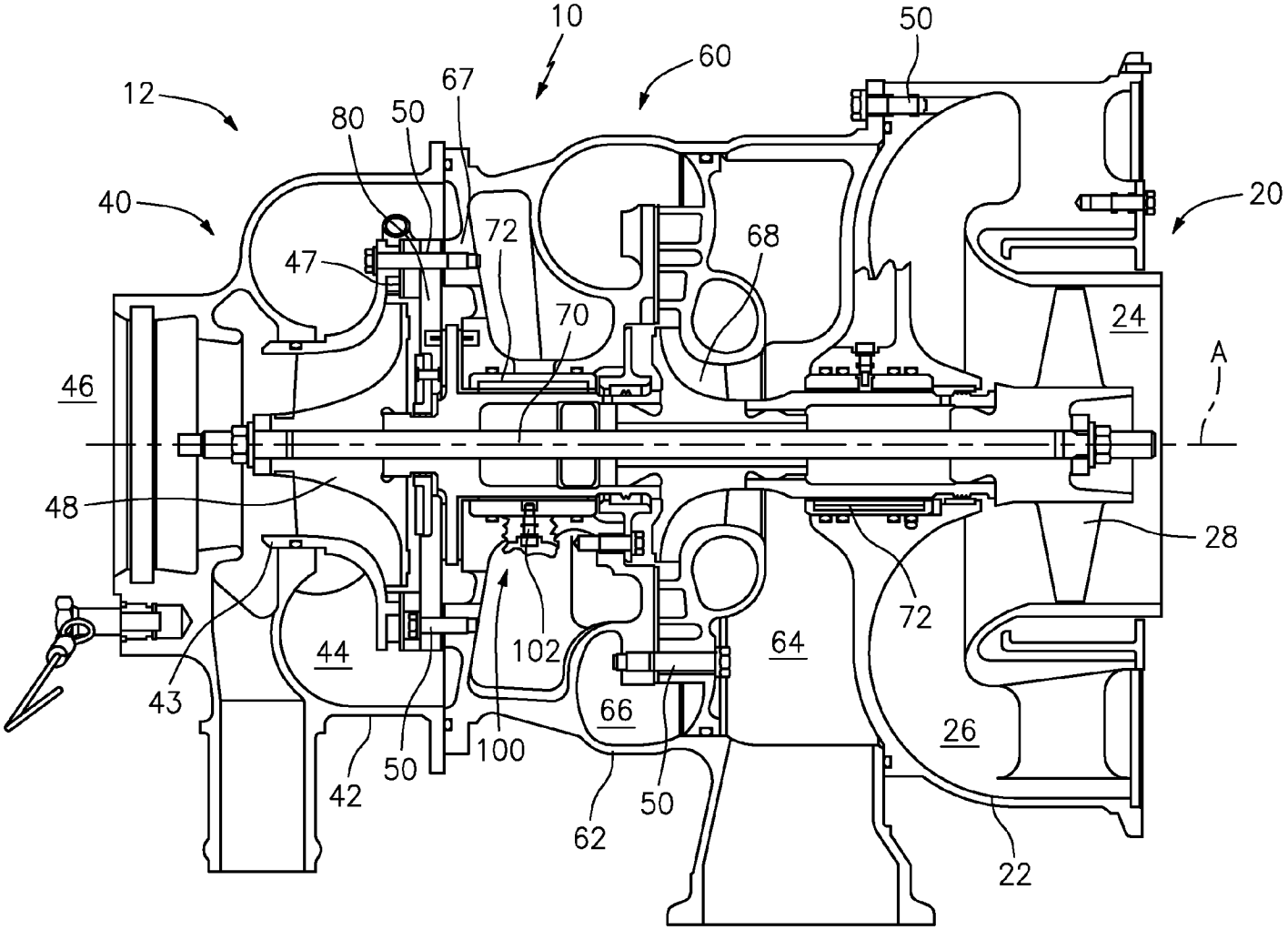
FIG. 1 is a cross-section of an air cycle machine (ACM) according to an embodiment.

Referring now to FIG. 1, an exemplary air cycle machine (ACM) 10 includes a fan 20, a turbine 40, and a compressor 60. The ACM 10 includes a housing assembly 12 manufactured from multiple housing portions to provide a desired clearance for the fan 20, the turbine 40, and the compressor 60. The ACM housing 12 includes a fan housing 22, a turbine housing 42, a compressor housing 62. The fan housing 22 and the turbine housing 42 are connected to the centrally located compressor housing 62 with fasteners 50. In one embodiment, a plurality of the fasteners 50 thread directly into the compressor housing 62.

The fan 20 has an inlet 24 and an outlet 26, and the turbine 40 has an inlet 44 and an outlet 46. The compressor 60 also includes an inlet 64 and an outlet 66. The fan 20 includes a fan rotor 28, the turbine 40 includes a turbine rotor 48, and the compressor 60 includes a compressor rotor 68. The fan rotor 28, the turbine rotor 48, and the compressor rotor 68 are coupled to a shaft 70 for rotation about an axis A, such that the turbine 40 drives the fan 20 and the compressor 60 via the shaft 70. In one embodiment, the shaft 70 is supported within the ACM housing 12 by bearings 72, such as hydrodynamic journal bearings, for example. The shaft 70 may include a plurality of apertures (not shown) such that a cooling flow enters into the shaft 70 to cool the bearings 72. One or more bearing anti-rotation pins can be used to prevent physical rotation of the bearings 72, such as bearing anti-rotation pin 102 depicted at a bearing anti-rotation pin region 100 in FIG. 1.

A seal plate 80 separates air flow between the turbine 40 and the compressor 60. The seal plate 80 is coupled to a turbine shroud 43, a plurality of turbine nozzles 47, and a plurality of bosses 67 of the compressor housing 62 using a plurality of the fasteners 50. Additional components, thread inserts, and seals (not depicted) may also be coupled by the fasteners 50. In an embodiment, the fasteners 50 are variously sized threaded bolts. The illustrated ACM 10 is exemplary and other configurations known to a person skilled in the art are within the scope of this invention. A combination of two or more components of the ACM 10 is referred to generally as an ACM assembly.

Figure 2:
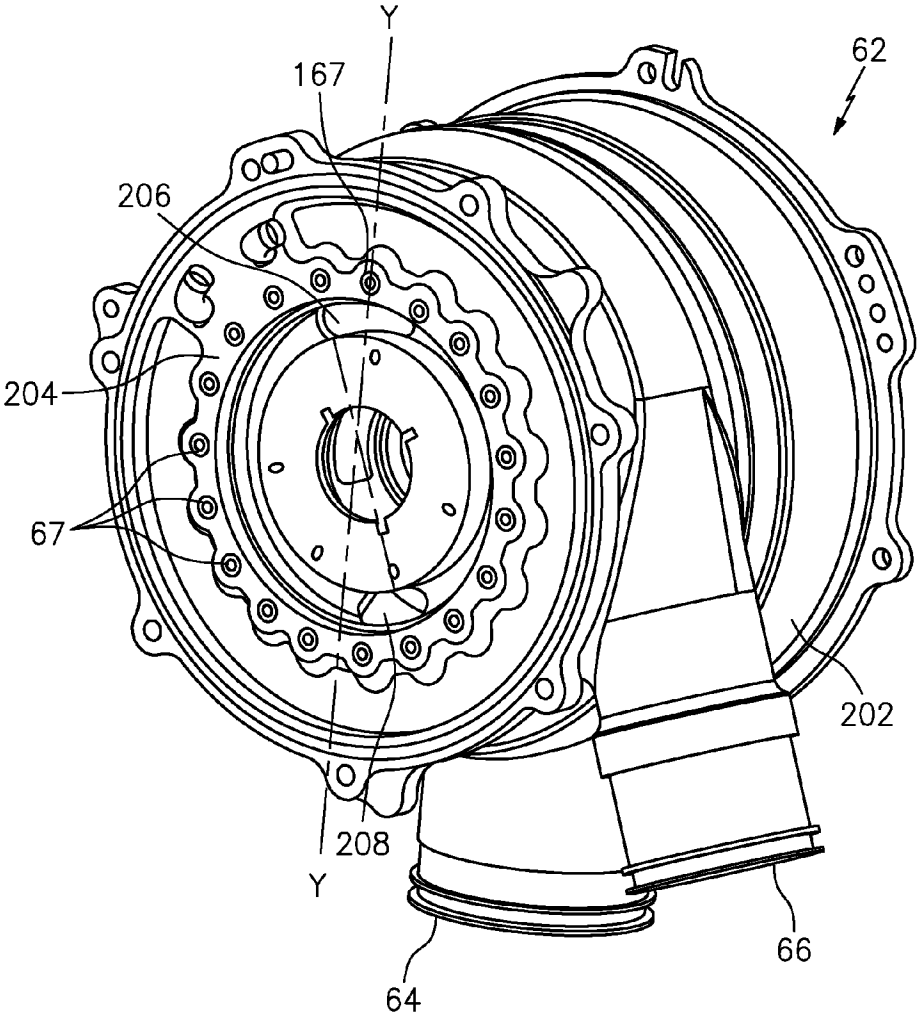
FIG. 2 is a perspective view of a compressor housing of the ACM of FIG. 1 according to an embodiment.

Referring now to FIG. 2, the compressor housing 62 is illustrated in more detail. In one embodiment, the compressor housing 62 is manufactured from a single piece of cast material, where a body 202 of the compressor housing 62 is a compressor volute configured to provide centrifugal compression in the ACM 10 of FIG. 1 between the compressor inlet 64 and the compressor outlet 66. The compressor housing 62 also includes a mating surface 204 integrally formed with the body 202. The mating surface 204 includes a plurality of substantially equally angularly spaced bosses 67. In an embodiment, there are nineteen bosses 67 on the mating surface 204. An upper most boss 167 at the twelve-o'clock position defines an axis Y that intersects an upper slot 206 and a lower slot 208 in the mating surface 204.

Figure 3:
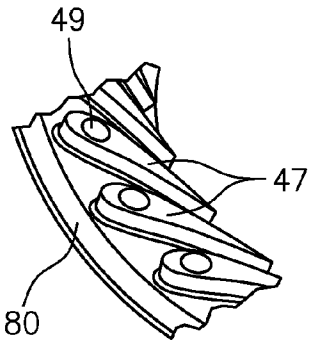
FIG. 3 is a partial perspective view of a seal plate and turbine nozzles of the ACM of FIG. 1 according to an embodiment.

FIG. 3 depicts the seal plate 80 and turbine nozzles 47 of the ACM 10 of FIG. 1 according to an embodiment. A plurality of the turbine nozzles 47 includes coupling apertures 49 configured to receive the fasteners 50 of FIG. 1; however, not all of the turbine nozzles 47 include the coupling apertures 49. In an embodiment, there are nineteen substantially equally angularly spaced turbine nozzles 47 that substantially align with the nineteen bosses 67 of the compressor housing 62 of FIG. 2 when assembled in the ACM 10 of FIG. 1, where seventeen of the nineteen turbine nozzles 47 are clamped to the compressor housing 62.

Figure 4:
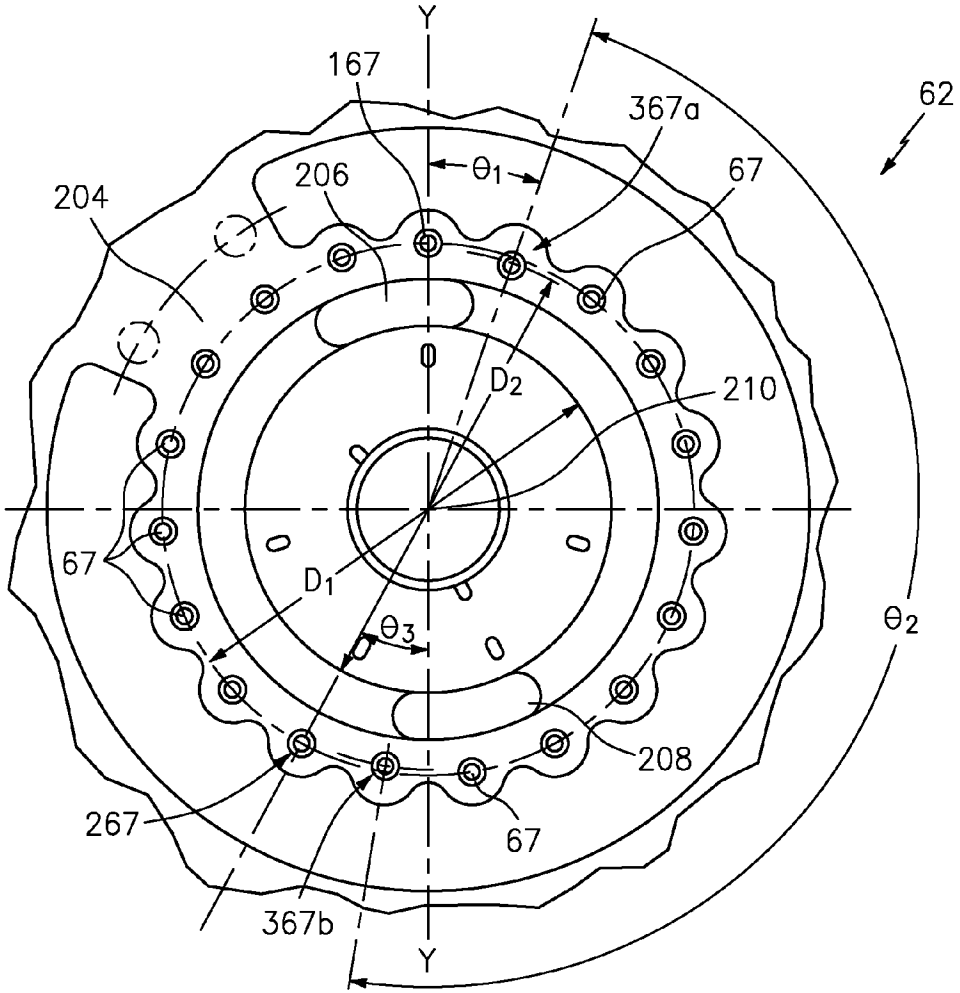
FIG. 4 is a partial front view of the compressor housing of FIGS. 1 and 2 according to an embodiment.

FIG. 4 is a partial front view of the mating surface 204 of the compressor housing 62 of FIG. 2 according to an embodiment. As previously described, the mating surface 204 includes a plurality of substantially equally angularly spaced bosses 67. The bosses 67 can include or receive threaded inserts (not depicted) to couple with threaded fasteners, such as the fasteners 50 of FIG. 1. The bosses 67 include a first boss type at a first radial distance $D_1$, which are each configured to receive one of the fasteners 50 coupled to one of the turbine nozzles 47 of the ACM 10 of FIG. 1. The bosses 67 also include a second boss type at a second radial distance $D_2$, which are configured to secure the seal plate 80 of the ACM 10 of FIG. 1 particularly during an assembly process. The second radial distance $D_2$ is less than the first radial distance $D_1$. In an embodiment, the first radial distance $D_1$ is about two percent greater than the second radial distance $D_2$. A ratio of a number of the bosses 67 of the first boss type to the second boss type is 17 to 2.

The bosses 67 are angularly spaced about nineteen degrees apart from each other. More particularly, the average angular spacing ($\Theta_1$) between each of the bosses 67 is 18.95 degrees. There can be some minor variation between the angular spacing of the bosses 67 such that the angular spacing may vary between about seventeen and twenty-one degrees between adjacent bosses 67. In the example of FIG. 4, there are seventeen bosses 67 of the first boss type and two bosses 67 of the second boss type. Bosses 167 and 267 are examples of the first boss type at the first radial distance $D_1$ from the center 210 of the mating surface 204. Bosses 367*a* and 367*b* are examples of the second boss type at the second radial distance $D_2$ from the center 210 of the mating surface 204. The bosses 367*a* and 367*b* have an angular offset ($\Theta_2$) of between about 170 to 190 degrees relative to each other. In the example of FIG. 4, $\Theta_2$ is 170.5 degrees. Each of the bosses 67 of the second boss type is adjacent to two bosses 67 of the first boss type.

As previously described in reference to FIG. 2, the upper most boss 167 at the twelve-o'clock position defines the axis Y that intersects the upper slot 206 and the lower slot 208 in the mating surface 204. Boss 267 of FIG. 4, which is a boss 67 of the first boss type, is offset by an angle ($\Theta_3$) of about 28 degrees relative to the axis Y. Boss 267 is adjacent to boss 367*b* of the second boss type. The boss 267 is also angularly aligned and adjacent to a recessed area 104 configured to receive the bearing anti-rotation pin 102 of FIG. 1, as best viewed in FIGS. 5-6.

Figure 6:
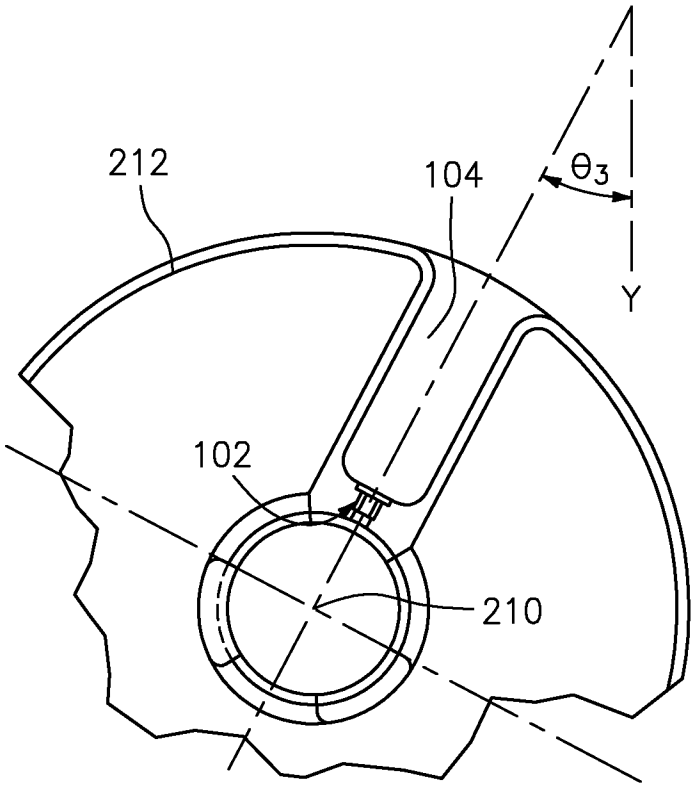
FIG. 6 is a cross-sectional view of the bearing anti-rotation pin region of FIG. 5 taken at line 6-6 according to an embodiment.
Figure 5:
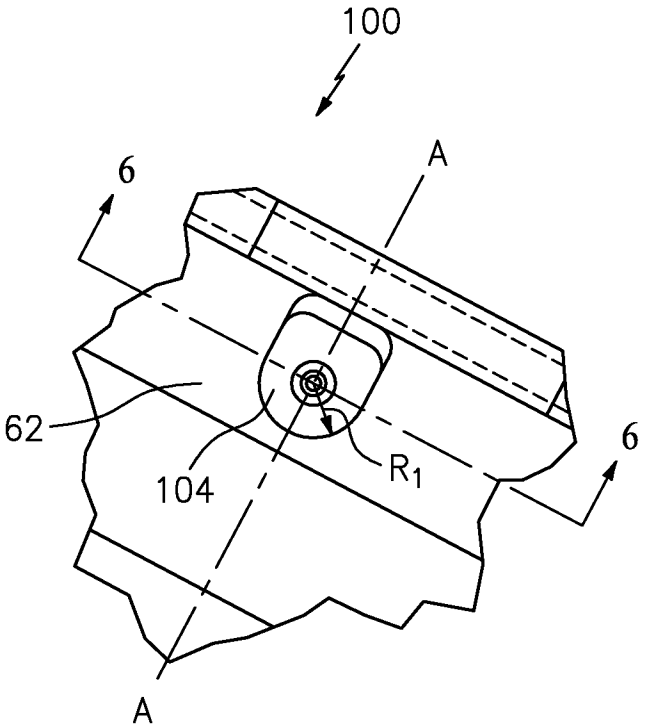
FIG. 5 is a partial bottom view of a bearing anti-rotation pin region of the compressor housing of FIGS. 1 and 2 according to an embodiment.

FIG. 5 is a partial bottom view of the bearing anti-rotation pin region 100 of the compressor housing 62 of FIG. 1 according to an embodiment. In an embodiment, the recessed area 104 has a radius $R_1$ of about 0.40 inches (1.02 cm). FIG. 6 is a cross-sectional view of the bearing anti-rotation pin region 100 of FIG. 5 taken at line 6-6 according to an embodiment. Relative to the axis Y of FIGS. 2 and 4, recessed area 104 is aligned at an angle ($\Theta_3$) of about 28 degrees. As can be seen in FIG. 6, the recessed area 104 extends from an exterior surface 212 of the body 202 of the compressor housing 62 towards the center 210 of the compressor housing 62. The bearing anti-rotation pin 102 is installed proximate to the center 210 of the compressor housing 62.

A process for installing the compressor housing 62 in the ACM 10 is described herein in reference to FIGS. 1-6. Seal plate 80 is aligned to mating surface 204 of the compressor housing 62. The seal plate 80 is secured to the mating surface 204 at each of the bosses 367*a* and 367*b* of the second boss type. Turbine nozzles 47 are aligned with each of the bosses 67. Each of the turbine nozzles 47 aligned with each of the bosses 67 of the first boss type (e.g., bosses 167 and 267) is clamped to the compressor housing 62 using threaded fasteners 50. According to an embodiment, each of the turbine nozzles 47 aligned with bosses 367*a* and 367*b* of the second boss type is not clamped to the compressor housing 62. As previously described, boss 267 of the first boss type is adjacent to boss 367*b* of the second boss type, and boss 267 is angularly aligned and adjacent to recessed area 104 which is configured to receive bearing anti-rotation pin 102. The bearing anti-rotation pin 102 is installed in the recessed area 104.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor housing for an air cycle machine, comprising:

a body comprising a compressor volute configured to provide centrifugal compression in the air cycle machine; and a mating surface integrally formed with the body, the mating surface comprising a plurality of bosses equally distributed with a same angular spacing relative to an axis of rotation in the air cycle machine, the bosses comprising a first boss type at a first radial distance from the axis of rotation in the air cycle machine and configured to receive a threaded fastener coupled to a turbine nozzle of the air cycle machine, and a second boss type at a second radial distance from the axis of rotation in the air cycle machine and configured to secure a seal plate of the air cycle machine, wherein the second radial distance is less than the first radial distance, and a ratio of a number of the bosses of the first boss type to the second boss type is 17 to 2, wherein each of the bosses of the second boss type is angularly offset from each of the bosses of the first type relative to the axis of rotation in the air cycle machine, and each of the bosses of the second boss type is angularly closer to two bosses of the first boss type than any other of the plurality of bosses relative to the axis of rotation in the air cycle machine.

2. The compressor housing according to claim 1, wherein a first boss of the first boss type is angularly adjacent to a second boss of the second boss type and the first boss is angularly aligned relative to the axis of rotation in the air cycle machine and angularly adjacent to a recessed area configured to receive a bearing anti-rotation pin in the air cycle machine, wherein the recessed area extends from an exterior surface of the body of the compressor housing towards the axis of rotation.

3. The compressor housing according to claim 1, wherein the bosses are angularly spaced 19 degrees apart from each other with respect to the axis of rotation in the air cycle machine.

4. The compressor housing according to claim 1, wherein the first radial distance is two percent greater than the second radial distance.

5. The compressor housing according to claim 1, wherein there are two bosses of the second boss type that have an angular offset of between 170 to 190 degrees relative to each other with respect to the axis of rotation in the air cycle machine.

6. An air cycle machine assembly comprising:

a plurality of turbine nozzles;

a seal plate; and a compressor housing comprising a body and a mating surface integrally formed with the body, the body comprising a compressor volute configured to provide centrifugal compression, and the mating surface comprising a plurality of bosses equally distributed with a same angular spacing relative to an axis of rotation in the air cycle machine assembly, the bosses comprising a first boss type at a first radial distance from the axis of rotation in the air cycle machine assembly and configured to receive a threaded fastener coupled to one of the turbine nozzles, and a second boss type at a second radial distance from the axis of rotation in the air cycle machine assembly configured to secure the seal plate, wherein the second radial distance is less than the first radial distance, and a ratio of a number of the bosses of the first boss type to the second boss type is 17 to 2, wherein each of the bosses of the second boss type is angularly offset from each of the bosses of the first type relative to the axis of rotation in the air cycle machine assembly, and each of the bosses of the second boss type is angularly closer to two bosses of the first boss type than any other of the plurality of bosses relative to the axis of rotation in the air cycle machine assembly.

7. The air cycle machine assembly according to claim 6, wherein a first boss of the first boss type is angularly adjacent to a second boss of the second boss type and the first boss is angularly aligned relative to the axis of rotation in the air cycle machine assembly and angularly adjacent to a recessed area configured to receive a bearing anti-rotation pin, wherein the recessed area extends from an exterior surface of the body of the compressor housing towards the axis of rotation.

8. The air cycle machine assembly according to claim 6, wherein the bosses are angularly spaced 19 degrees apart from each other with respect to the axis of rotation in the air cycle machine assembly.

9. The air cycle machine assembly according to claim 6, wherein the first radial distance is two percent greater than the second radial distance.

10. The air cycle machine assembly according to claim 6, wherein there are two bosses of the second boss type that have an angular offset of between 170 to 190 degrees relative to each other with respect to the axis of rotation in the air cycle machine assembly.

11. The air cycle machine assembly according to claim 6, wherein each of the turbine nozzles is axially aligned with one of the bosses; each of the turbine nozzles axially aligned with the bosses of the first boss type is clamped to the compressor housing by a threaded fastener; and each of the turbine nozzles axially aligned with the bosses of the second boss type is not directly clamped to the compressor housing by a fastener contacting the compressor housing and the turbine nozzles axially aligned with the bosses of the second boss type.

12. A method of installing a compressor housing in an air cycle machine assembly, comprising:

aligning a seal plate to a mating surface of the compressor housing, the compressor housing comprising a body, wherein the mating surface is integrally formed with the body, the mating surface comprising a plurality of bosses equally distributed with a same angular spacing relative to an axis of rotation in the air cycle machine assembly, the bosses comprising a first boss type at a first radial distance from the axis of rotation in the air cycle machine assembly and a second boss type at a second radial distance from the axis of rotation in the air cycle machine assembly that is less than the first radial distance, and a ratio of a number of the bosses of the first boss type to the second boss type is 17 to 2, wherein each of the bosses of the second boss type is angularly offset from each of the bosses of the first type relative to the axis of rotation in the air cycle machine assembly, and each of the bosses of the second boss type is angularly closer to two bosses of the first boss type than any other of the plurality of bosses relative to the axis of rotation in the air cycle machine assembly;

securing the seal plate to the bosses of the second boss type at each of the bosses of the second boss type;

axially aligning a turbine nozzle with each of the bosses; and clamping each of the turbine nozzles axially aligned with each of the bosses of the first boss type to the compressor housing using threaded fasteners.

13. The method according to claim 12, wherein a first boss of the first boss type is angularly adjacent to a second boss of the second boss type and the first boss is angularly aligned relative to the axis of rotation in the air cycle machine assembly and angularly adjacent to a recessed area configured to receive a bearing anti-rotation pin, wherein the recessed area extends from an exterior surface of the body of the compressor housing towards the axis of rotation.

14. The method according to claim 13, further comprising installing the bearing anti-rotation pin in the recessed area.

15. The method according to claim 12, wherein the bosses are angularly spaced 19 degrees apart from each other with respect to the axis of rotation in the air cycle machine assembly.

16. The method according to claim 12, wherein each of the turbine nozzles axially aligned with the bosses of the second boss type is not directly clamped to the compressor housing by a fastener contacting the compressor housing and the turbine nozzles axially aligned with the bosses of the second boss type.

17. The method according to claim 12, wherein the first radial distance is two percent greater than the second radial distance.

18. The method according to claim 12, wherein there are two bosses of the second type that have an angular offset of between 170 to 190 degrees relative to each other with respect to the axis of rotation in the air cycle machine assembly.

* * * * *